US009997062B2

(12) United States Patent
Woodard

(10) Patent No.: US 9,997,062 B2
(45) Date of Patent: Jun. 12, 2018

(54) SYSTEMS AND METHODS FOR LIMITING REMOTE-CONTROL DEVICE MODE CHANGES

(71) Applicant: DISH Technologies L.L.C., Englewood, CO (US)

(72) Inventor: Alexander David Woodard, Greenwood Village, CO (US)

(73) Assignee: DISH Technologies L.L.C., Englewood, CO (US)

( * ) Notice: Subject to any disclaimer, the term of this patent is extended or adjusted under 35 U.S.C. 154(b) by 0 days. days.

(21) Appl. No.: 15/241,654

(22) Filed: Aug. 19, 2016

(65) Prior Publication Data

US 2018/0053402 A1 Feb. 22, 2018

(51) Int. Cl.
*G08C 17/02* (2006.01)

(52) U.S. Cl.
CPC ..... *G08C 17/02* (2013.01); *G08C 2201/20* (2013.01); *G08C 2201/92* (2013.01)

(58) Field of Classification Search
CPC ..... G08C 17/02; G08C 2201/20; G08C 2201/21; G08C 2201/92; G08C 2201/93; H04N 2005/4444
See application file for complete search history.

(56) References Cited

U.S. PATENT DOCUMENTS 7,814,510 B1 10/2010 Ergen et al.
2008/0001773 A1* 1/2008 Rye ..... G08C 17/00 340/4.31
2011/0090408 A1* 4/2011 Ergen ..... G08C 17/02 348/734

* cited by examiner

*Primary Examiner* — Kabir A Timory
(74) *Attorney, Agent, or Firm* — Seed IP Law Group LLP

(57) ABSTRACT

Various embodiments provide a systems and methods for a remote-control device to limit changes from one mode to a plurality of different modes. In response to a particular button press, sequence of button activations, time-dependent button presses and/or other type of input being entered on the remote-control device indicative of a command to limit mode changes, remote-control device prevents changing from one mode to a plurality of different modes until another command or input is received to allow such mode changes. The plurality of modes which the remote-control device is prevented changing to or changing from may be selectable by the user.

25 Claims, 7 Drawing Sheets

SYSTEMS AND METHODS FOR LIMITING REMOTE-CONTROL DEVICE MODE CHANGES

TECHNICAL FIELD

The technical field relates to remote-control devices, and more particularly, to apparatuses, systems and methods for operation of remote-control devices.

BRIEF SUMMARY

In one embodiment, a remote-control device may control what mode the remote-control device is in and may limit what modes the remote-control device may change to and change from. For example, while in a satellite mode, the remote-control device may send commands to control a satellite receiver when particular buttons are pressed on the remote-control device. While in a television mode, the remote-control device may instead send commands to control a television when those same buttons are pressed on the remote-control device. Furthermore, while in an auxiliary mode, the remote-control device may instead send commands to control an auxiliary device when those same buttons are pressed on the remote-control device. Mode changes may be initiated as a result of a user activating a mode button or other mode control on the remote-control device corresponding to the desired mode (e.g., satellite mode, television mode, and auxiliary mode). However, for those users unfamiliar with the operation of the remote-control device, pressing such mode buttons may occur inadvertently, causing the remote to be placed in an undesired mode without the user's knowledge. Thus, in response to a particular button press, sequence of button activations, time-dependent button presses and/or other type of input being entered on the remote-control device indicative of a command to limit mode changes, the remote-control device may prevent changing to a plurality of different modes and/or changing between modes until another command or input is received to allow such mode changes.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
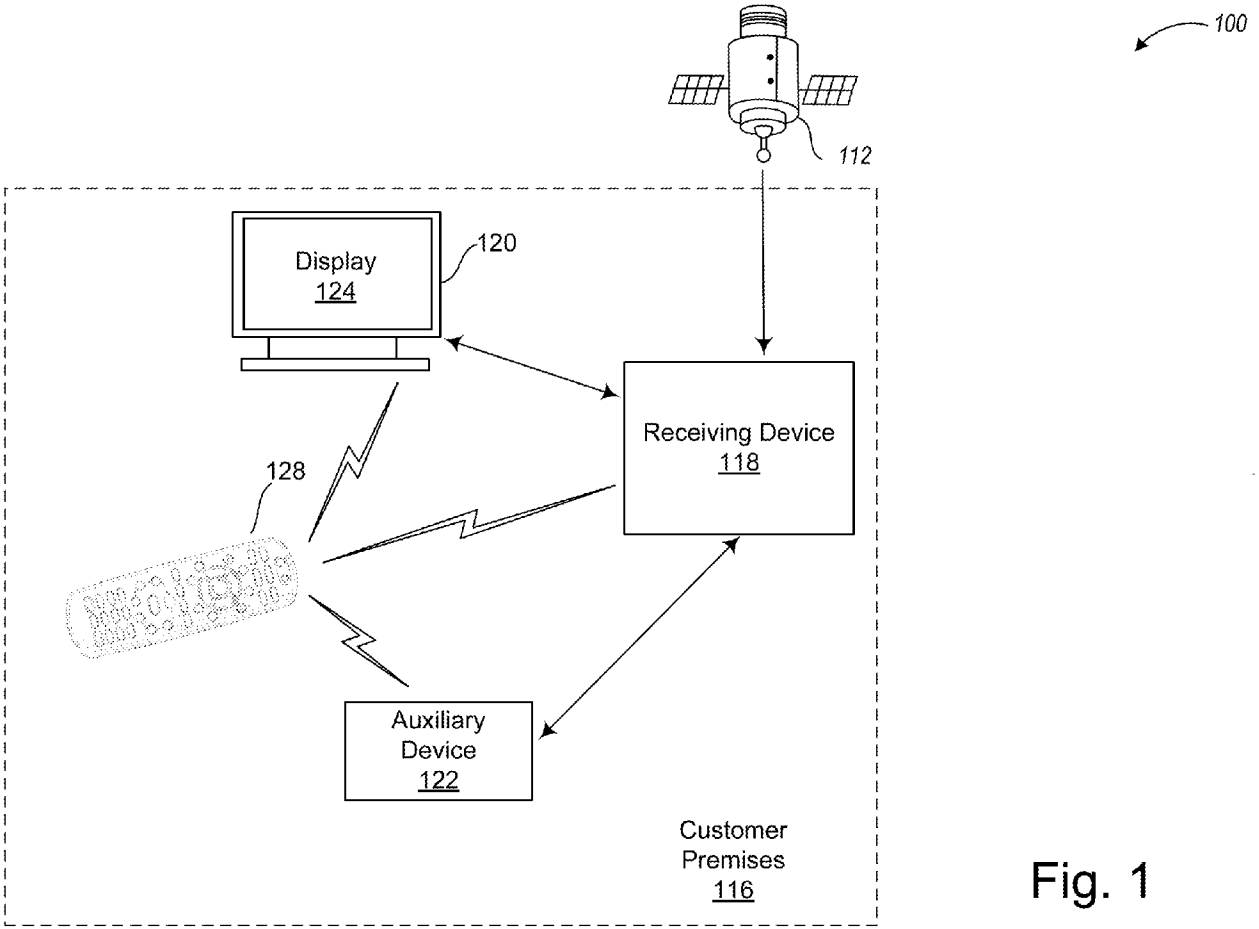
FIG. 1 is a block diagram illustrating an example environment in which various embodiments of systems and methods for limiting remote-control device mode changes may be implemented.

FIG. 1 is an overview block diagram illustrating an example environment 100 in which various embodiments of systems and methods for limiting remote-control device mode changes may be implemented. It is to be appreciated that FIG. 1 illustrates just one example of a customer premises 116 environment and that the various embodiments discussed herein are not limited to use of such systems. Customer premises 116 can include a variety of communication systems and can use a variety of communication devices, presentation devices and media including, but not limited to, media provided by satellite, cable and Internet streaming services.

Audio, video, and/or data service providers, such as, but not limited to, television service providers, provide their customers a multitude of audio/video and/or data programming (hereafter, collectively and/or exclusively "programming"). Such programming is often provided by use of a receiving device 118 communicatively coupled to a presentation device 120 configured to receive the programming.

Receiving device 118 interconnects to one or more communications media or sources, such as a cable head-end, satellite antenna, telephone company switch, Ethernet portal, off-air antenna, or the like, that provide the programming. The receiving device 118 commonly receives a plurality of programming by way of the communications media or other sources. Based upon selection by the user, the receiving device 118 processes and communicates the selected programming to the one or more presentation devices 120.

The receiving device 118 may include devices such as a "television converter," "receiver," "set-top box," "television receiving device," "television receiver," "television recording device," "satellite set-top box," "satellite receiver," "cable set-top box," "cable receiver," "media player," "Internet streaming device" and/or "television tuner." Accordingly, the receiving device 118 may be any suitable converter device or electronic equipment that is operable to receive programming. Further, the receiving device 118 may itself include user interface devices, such as buttons, switches and displays. In many applications, a remote-control device ("remote") 128 is operable to control the presentation device 120 and other auxiliary devices, such as auxiliary device 122.

Examples of a presentation device 120 include, but are not limited to, a television ("TV"), a personal computer ("PC"), a sound system receiver, a digital video recorder ("DVR"), a compact disk ("CD") device, game system, or the like. Presentation devices 120 may employ a display 124, one or more speakers (not shown), and/or other output devices to communicate video and/or audio content to a user. In many implementations, one or more presentation devices 120 reside in or near a customer's premises 116 and are communicatively coupled, directly or indirectly, to the receiving device 118. Further, the receiving device 118 and the presentation device 120 may be integrated into a single device. Such a single device may have the functionality of the receiving device 118 described herein and the presentation device 120, or may even have additional functionality.

In at least one embodiment, the received program content is communicated (i.e., "uplinked") to one or more satellites 112. It is to be appreciated that the communicated uplink signal may contain a plurality of multiplexed programs. The uplink signal is received by the satellite 112 and then communicated (i.e., "downlinked") from the satellite 112 in one or more directions, for example, onto a predefined portion of the planet. It is appreciated that the format of the above-described signals are adapted as necessary during the various stages of communication.

The signal may be received by a receiving device 118. The receiving device 118 is a conversion device that converts, also referred to as formatting, the received signal into a signal suitable for communication to a presentation device 120 and/or an auxiliary device 122. The received signal communicated to the receiving device 118 is a relatively weak signal that is amplified, and processed or formatted, by the receiving device 118. The amplified and processed signal is then communicated from the receiving device 118 to the presentation device 120, such as a television ("TV") or the like, and/or to an auxiliary device 122 in a suitable format. It is to be appreciated that presentation device 120 may be any suitable device operable to present a program having video information and/or audio information.

Auxiliary device 122 may be any suitable device that is able to be controlled by the remote 128, for example, those devices operable to receive a signal from the receiving device 118, another endpoint device, or from other devices external to the customer premises 116. Additional non-limiting examples of an auxiliary device 122 include optical media recorders, such as a compact disk ("CD") recorder or changer, a digital versatile disc or digital video disc ("DVD") recorder, a digital video recorder ("DVR"), a personal video recorder ("PVR"), an amplifier, a radio, a tape deck, a turntable, receiver, a media device, or a streaming media device. Auxiliary device 122 may also include game devices, magnetic tape type recorders, RF transceivers, personal computers ("PCs"), and personal mobile computing devices such as cell phones, mobile devices, tablets or personal digital assistants (PDAs). The customer premises 116 may have multiple auxiliary devices that are able to be controlled by the remote 128, some or all of which may be in operable communication with the receiving device 118 or other devices.

The receiving device 118 may receive programming partially from, or entirely from, another source other than that described above. Other embodiments of the receiving device 118 may receive locally broadcast RF signals, or may be coupled to communication system via any suitable medium. Non-limiting examples of medium communicatively coupling the receiving device 118 to communication system include cable, fiber optic, or Internet media.

Customer premises 116 may include other devices which are communicatively coupled to the receiving device 118 and/or a communication system via a suitable media. For example, some customer premises 116 include an optional network, communication system or networked system (not shown), to which receiving device 118, presentation device 120, and/or a variety of auxiliary devices, such as auxiliary device 122 can be coupled, collectively referred to as endpoint devices. Non-limiting examples of such a network or communication system include, but are not limited to, an Ethernet system, twisted pair Ethernet system, an intranet, a local area network ("LAN") system, short range wireless network (e.g., Bluetooth®), a personal area network (e.g., a Zigbee network based on the IEEE 802.15.4 specification), a Consumer Electronics Control (CEC) communication system or the like. One or more endpoint devices, such as PCs, data storage devices, TVs, game systems, sound system receivers, Internet connection devices, digital subscriber loop ("DSL") devices, wireless LAN, WiFi, Worldwide Interoperability for Microwave Access ("WiMax") devices, or the like, may be communicatively coupled to the network or to each other so that the plurality of endpoint devices are communicatively coupled together. Thus, such a network allows the interconnected endpoint devices, and the receiving device 118, to communicate with each other. Alternatively, or in addition, some devices in the customer premises 116 may be directly connected to the network, such as a telephone which may employ a hardwire connection or an RF signal for coupling to the network, which may also connect to other networks or communications systems outside customer premises 116.

An interface between the receiving device 118 and a user may be provided by a hand-held remote-control device (i.e., "remote") 128. Remote 128 typically communicates with the receiving device 118 using a suitable wireless medium, such as infrared ("IR"), radio frequency ("RF"), or the like and may be any wireless handheld device, including a mobile device such as a cellular telephone or a tablet device. Other input or control devices (not shown) may also be communicatively coupled to the receiving device 118. Non-limiting examples include game device controllers, keyboards, touch pads, touch screens, pointing devices and the like. The remote 128 may also control other devices, such as the auxiliary device 122, presentation device 124 and/or other endpoint devices (not shown). The remote 128 may be a "universal" remote or otherwise programmable or configurable by a manufacturer, user and/or other device to control such other devices.

In some embodiments, the remote 128 may be a multi-brand remote that comes to the user preprogrammed with the codes to operate a number of standard home electronic devices. Such a remote may be able to control multiple devices and, in some embodiments, control their main functions, such as channel turning, volume control and other functions. The remote 128 may also be a "learning" remote. In particular, while the remote 128 may be preprogrammed to operate a number of popular electronic models, it may also have the ability to learn the functions of the original manufacturer's remote of each device. For example, this may be accomplished by placing the remote 128 head-to-head with the device's original manufacturer's remote and infrared signals will be transmitted to the learning remote that allow it to duplicate the other remote's commands. Such learning can also be accomplished via RF or wired communication between remote-control devices and/or other devices.

In order to have the remote 128 send the correct command to the device the user currently wants to control, in some embodiments, remote 128 may have a plurality of different modes in which a set of controls on the remote 128 are used to control a particular device when in a mode corresponding to that device. For example, the remote 128 may have a satellite mode in which functions of a set of input controls on the remote 128 control a satellite receiver, which is a type of receiving device 118, while the remote 128 is in the satellite mode. Also, the remote 128 may also have a TV mode in which the functions of the same set of input controls are changed to perform functions to control a television, which is a type of presentation device 124, when the remote 128 enters the TV mode. Additionally, the remote 128 may have an auxiliary (i.e., "AUX") mode in which the functions of the same set of input controls are changed to perform functions to control an auxiliary device 122 when the remote 128 enters the auxiliary mode.

Additional and/or different modes may also exist corresponding to control of other devices which, when entered, cause the remote 128 to be able to control the corresponding device. In some embodiments, the remote 128 is also configured to establish a master-slave relationship between the remote 128, receiving device 118, presentation device 124 and the auxiliary device 122 when the remote 128 enters a mode corresponding to the particular device. This may be accomplished by making the remote 128 operable to control the particular device and possibly disabling other remote control devices (not shown) from being able to control the particular device when the remote 128 is in the mode corresponding to the particular device. For example, the remote 128 can be used to identify itself as a master remote with respect to one or more other remote-control devices and/or other devices. In this manner, the remote 128 can be configured to be the sole remote-control device on the customer premises 116 that is able to control a particular device while the remote 128 is in a mode corresponding to that device.

The remote may enter each mode by the user pressing or otherwise activating a button, switch or other control or sequence of controls on the remote 128 corresponding to the particular desired mode. For example, see example mode control buttons 304, 306, 308, 310, 314 and 314 on the remote 128 in FIG. 3. In this manner, the user may cause the remote 128 to switch between modes when activating on the remote 128 the corresponding mode control of the desired mode. However, in some instances it may be beneficial for an end user to be able to selectively limit the modes into which the remote may enter, as will be explained in further detail below.

The above description of the customer premises 116, and the various devices therein, is intended as a broad, non-limiting overview of an example environment in which various embodiments of a remote 128 may be implemented. The customer premises 116 and the various devices therein, may contain other devices, systems and/or media not specifically described herein.

Example embodiments described herein provide applications, tools, data structures and other support to implement systems and methods for limiting remote-control device mode changes with respect to a remote that may control various media devices. Other embodiments of the described techniques may be used for other purposes, including for limiting mode changes in systems generally. In the following description, numerous specific details are set forth, such as data formats, code sequences, and the like, in order to provide a thorough understanding of the described techniques. The embodiments described also can be practiced without some of the specific details described herein, or with other specific details, such as changes with respect to the ordering of the code flow, different code flows, and the like. Thus, the scope of the techniques and/or functions described are not limited by the particular order, selection, or decomposition of steps described with reference to any particular module, component, or routine.

Figure 2:
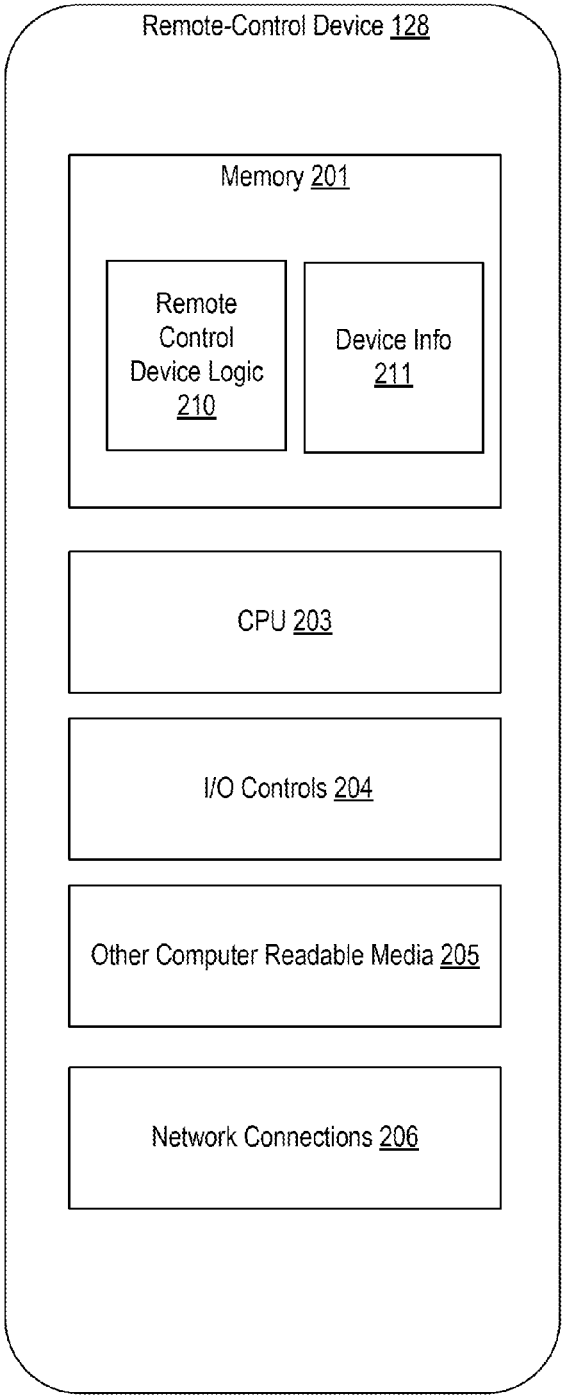
FIG. 2 is a block diagram illustrating components of an example embodiment of a remote-control device for limiting remote-control device mode changes.

FIG. 2 is a block diagram illustrating components of an example embodiment of a remote-control device 128 for limiting remote-control device mode changes. In one embodiment, remote 128 comprises a computer memory ("memory") 201 and one or more Central Processing Units ("CPU") 203. Also included are Input/Output "I/O" controls 204, including, but not limited to: buttons, virtual buttons, switches, keypads, keyboards, touchpads, touchscreens, display screens, liquid crystal displays, speakers, scroll wheel inputs, optical sensors, gesture sensors, accelerometers, motion control sensors, voice command sensors, microphones, track ball's and/or joysticks, etc. The remote 128 may also include other computer-readable media 205 (e.g., flash memory, SIM card) and network connections 206. For example, the I/O controls 204 may include buttons such as those shown in FIG. 3, although different numbers and configurations of controls exist in various embodiments, including those with touch screen buttons and other input controls. The network connections 206 include one or more communication interfaces to various media devices, including but not limited to, radio frequency transceivers, infrared transceivers, wireless Ethernet ("Wi-Fi") interfaces, short range wireless (e.g., Bluetooth®) interfaces and the like. The one or more Central Processing Units ("CPU") 203 may be communicatively coupled to the memory 201 and the Input/Output controls 204, other computer-readable media 205 and network connections 206, (e.g., via a communications bus) in a manner to control one or more operations of those various components.

The remote 128 may communicate with receiving device 118, presentation device 124, and possibly other media devices such as the auxiliary device 122 shown in FIG. 1. Example media devices include other remote-control devices, media players, streaming media devices, DVRs, DVD players, video recorders, audio systems, displays, personal computers, set-top boxes, mobile devices and the like. Other types of auxiliary devices include control systems for home electromechanical systems, such as a lighting system, security system, video camera system, climate control system, spa/pool, and the like.

Remote-control device logic 210 and device information 211 is shown residing in memory 201. In other embodiments, some portion of the device information and some of, or all of, the components of the logic 210 may be stored on the other computer-readable media 205. The logic 210 preferably executes on one or more CPUs 203 and manages operation of the remote 128, as described herein. The logic 210 may comprise or implement a system control module as executed by one or more CPUs 203 that are communicatively coupled to the I/O controls 204 and other components of the remote 128. Other code or programs and potentially other data/information (not shown), may also reside in the memory 201, and may execute on one or more CPUs 203. Of note, one or more of the components in FIG. 2 may not be present in any specific implementation. For example, some embodiments may not provide other computer readable media 205.

The logic 210 performs the core functions of the remote 128, as discussed herein and also with respect to FIGS. 3 through 7. In particular, the logic 210 reads input that results from activation of I/O controls 204 on the remote 128 by the user and performs the function corresponding to the input, including sending commands to various devices and performing internal operations of the remote 128.

The remote 128 may be in one of a plurality of different modes at any given time. One or more of the I/O controls 204 may be configured to perform different functions depending on the corresponding mode the remote 128 is in. For example, a group of the I/O controls 204 may control a first device when the remote 128 is in the first mode. That same group of I/O controls 204 may instead control a second device when the remote 128 is in a second mode. Furthermore, that same group of I/O controls 204 may control a third device instead of the first or second device when the remote 128 is in a third mode. The various devices are controlled by the logic 210 causing the remote 128 to send commands recognized by the particular device. For example, in the first mode, the activation of a particular button on the remote 128 by a user will cause the remote 128 to send a command to the first device corresponding to the function of that button. In the second mode, the activation of that same button on the remote 128 by the user will cause the remote 128 to send a different command corresponding to the second device. Additional modes may also exist in various embodiments.

The logic 210 may control what mode the remote 128 is in and may limit what modes the remote 128 may change to and change from. In some embodiments, mode changes may be initiated as a result of a user activating a mode button or other mode control on the remote 128 corresponding to the desired mode (see example mode control buttons 304, 306, 308, 310, 314 and 314 on the remote 128 in FIG. 3). However, for those users unfamiliar with the operation of the remote 128, pressing such mode buttons may occur inadvertently, causing the remote to be placed in an undesired mode without the user's knowledge. Thus, in response to a particular button press, sequence of button activations, time-dependent button presses and/or other type of input being entered on the remote 128 indicative of a command to limit mode changes, the logic 210 may cause the remote 128 to prevent the remote 128 from changing to one or more different modes and/or changing between modes until another command or input is received to again allow such mode changes.

In one embodiment, a user may enter the command to limit mode changes and, in response, the logic 210, when executed by the CPU 203, will prevent mode changes from the current mode to any other mode. For example, while the remote is in the "satellite" mode in which a group of the I/O controls 204 is configured to control a satellite television receiver, the user may enter the command to limit mode changes and, in response, the remote 128 will prevent mode changes from the satellite mode to other modes even if other the mode buttons on the remote 128 are pressed. In some embodiments, an indicator (e.g., a light emitting diode (LED) or a textual indication on a display) on the remote 128 may be configured to indicate whether the remote-control device is currently is a state to prevent mode changes.

The remote 128 may be in this limited mode state in which other modes are "locked out" until such time the user enters a command to allow mode changes again. Such other modes may include, but are not limited to a "TV" mode in which in which the group of the controls 204 is configured to control a television; an "auxiliary" mode in which the group of controls 204 is configured to control an auxiliary device; a "DVR" mode in which in which the group of controls 204 is configured to control a digital video recorder; a "DVD" mode in which in which the group of controls 204 is configured to control a digital video disc player; a "media player" mode in which the group of the controls 204 is configured to control a media player; a "device 1" mode in which the group of the controls 204 is configured to control a device selected by a user, etc. Additional or different modes may be present in various other embodiments. Also, for some of the controls 204, the command sent when those controls are activated may remain the same regardless of what mode the remote 28 is in.

In some embodiments, there may be modes corresponding to one or more devices that the user has programmed, taught or otherwise customized the remote 128 to control when in the corresponding mode. Also, in some embodiments, the logic 210, when executed by the CPU 203, instead of preventing mode changes from the current mode, prevents mode changes from a particular mode, which may be selectable by the user, and not from other modes. For example, mode changes from "satellite" mode to other modes may be prevented after the command limiting mode changes is entered, but changes from other modes may be allowed. In some embodiments, this may occur regardless of what mode the remote 128 is currently in when the command limiting mode changes is entered. For example, if the remote 128 is currently in the "TV" mode and then the user enters the command limiting mode changes, the logic 210 may cause the remote 128 to allow changes to the "satellite" mode, but once in the "satellite" mode, the remote 128 will be prevented from changing back to any other mode. The remote 128 preventing mode changes from a particular mode and not preventing changes from other modes may also be selectable by the user.

In some embodiments, the user may select which modes the remote 128 will be prevented from changing to and/or prevented changing from. For example, the remote 128 may have six modes and the user may select to have the remote 128 to only be able to change between two of those six modes in response to receiving the remote 128 mode change limiting command. Also, the logic 210 may enable the remote 128 to accept various different mode change limiting commands to limit mode changes from or to various different selected modes, or different groups of modes, depending on the particular mode change limiting command entered by the user.

In some embodiments, the user may select which modes to limit changes to or from, what input corresponds to various commands to limit or allow mode changes, and in what circumstances such mode changes may be limited. This may be selectable by the user on a display or other interface that is part of the I/O controls 204 on the remote 128 or on a user interface implemented on a display device in communication with the remote 128 via network connections 206. Such selections and configurations may be stored on the remote 128 in memory 201, on other computer readable media and/or on a device external to the remote 128 that is in communication with the remote 128 via network connections 206.

In one embodiment, limiting a mode change may be performed by the remote control device logic 210 causing the remote 128 to ignore the input received from a user pressing a corresponding mode button. In other embodiments, the limiting of a mode change may be performed by the remote control device logic 210 causing the corresponding mode buttons to be temporarily disabled, either electronically or mechanically. In yet other embodiments, the limiting of a mode change may be performed by the remote control device logic 210 causing the remote 128 to temporarily enter the mode corresponding to the mode button pressed by the user, but then immediately changing back to the previous mode.

Also, the logic 210 may gather information about various media devices, such as receiving device 118, presentation device 120, auxiliary device 122 and/or other devices and store that information as device information 211. In some embodiments, storing such information may be in order for the logic 210 to know which commands to send to a particular device when corresponding controls (e.g., buttons) are activated on the remote 128 when in the mode corresponding to that particular device. For example, the device information 211 may include, but is not limited to, a database of identifiers of various devices, device codes, identifiers of various corresponding modes, device commands, programmed macros, learned device commands, other remote control commands corresponding to those devices and which buttons or other I/O controls 204 on the remote 128, when activated, are to cause those commands to be sent. The device information 211 may also store user preference data, user profile data, user credential or identity data and/or other user-related data. In this manner, various user profiles may be stored or otherwise accessed that prevent or allow changing to or from particular modes, or groups of modes, based on a particular user identified as using the remote 128 or being logged in a system that includes the remote 128. In some embodiments, the user may be identified by password entry, fingerprint reader or other biometric data sensor or reader included in the I/O controls of the remote 128.

The logic 210 also manages master-slave relationships with other media devices. A network of master-slave relationships known to the remote 128 is stored in device information 411. In addition, changes to various master-slave relationships are regulated by the logic 210, and may affect the current mode into which the logic 210 may put the remote 128 according to the type of device or type of user interface of the device (e.g., whether the user interface of the device uses a cursor, text input, etc.). Such an automatic mode change may be overridden by the user inputting the command to limit mode changes. The logic 210 may also cause the remote 128 to establish a master-slave relationship between the remote 128, receiving device 118, presentation device 124 and the auxiliary device 122 when the remote 128 enters a mode corresponding to the particular device. This may be accomplished by making the remote 128 operable to control the particular device and possibly disabling other remote control devices (not shown) from being able to control the particular device when the remote 128 is in the mode corresponding to the particular device. For example, the remote 128 can be used to identify itself as a master remote with respect to one or more other remote-control devices and/or other devices. In this manner, the remote 128 can be configured to be the sole remote-control device on the customer premises 116 that is able to control a particular device while the remote 128 is in a mode corresponding to that device.

In at least some embodiments, remote and/or programmatic access is provided to at least some of the functionality of the remote 128. For example, the remote 128 may provide to other media devices an application program interface ("API") that provides access to various functions of the remote 128, including access to information stored by the remote 128 (e.g., about other media devices), current mode, whether the remote 128 is in a state in which mode changes are limited, the master/slave status of the remote 128, and the like. In this manner, the API may facilitate the development of third-party software, such as user interfaces, plug-ins, adapters and the like, such as for integrating functions of the remote 128 into various user interface applications on media devices and various desktop or mobile device applications. For example, a particular media device may present a customized or different user interface based upon the functionality and capabilities of the remote 128 and/or based on whether the remote 128 is in a state in which mode changes are limited.

In an example embodiment, the logic 210 is implemented using standard programming techniques. For example, the logic 210 may be implemented as a "native" executable running on the CPU 203, along with one or more static or dynamic libraries. In other embodiments, the logic 210 may be implemented as instructions processed by a virtual machine that executes as some other program. In general, a range of programming languages known in the art may be employed for implementing such example embodiments, including representative implementations of various programming language paradigms and platforms, including but not limited to, object-oriented (e.g., Java, C++, C#, Visual Basic.NET, Smalltalk, and the like), functional (e.g., ML, Lisp, Scheme, and the like), procedural (e.g., C, Pascal, Ada, Modula, and the like), scripting (e.g., Perl, Ruby, PHP, Python, JavaScript, VBScript, and the like) and declarative (e.g., SQL, Prolog, and the like).

The embodiments described above may also use well-known or synchronous or asynchronous client-server computing techniques. However, the various components may be implemented using more monolithic programming techniques as well, for example, as an executable running on a single CPU computer system, or alternatively decomposed using a variety of structuring techniques known in the art, including but not limited to, multiprogramming, multithreading, client-server, or peer-to-peer, running on one or more computer systems each having one or more CPUs. Some embodiments may execute concurrently and asynchronously, and communicate using message passing techniques. Equivalent synchronous embodiments are also supported. Also, other functions could be implemented and/or performed by each component/module, and in different orders, and by different components/modules, yet still achieve the functions of the remote 128.

In addition, programming interfaces to the data stored as part of the device information 211, can be available by standard mechanisms such as through C, C++, C#, and Java APIs; libraries for accessing files, databases, or other data repositories; through scripting languages such as JavaScript and VBScript; or through Web servers, FTP servers, or other types of servers providing access to stored data. The device information 211 may be implemented as one or more database systems, file systems, or any other technique for storing such information, or any combination of the above, including implementations using distributed computing techniques.

Different configurations and locations of programs and data are contemplated for use with techniques described herein. A variety of distributed computing techniques are appropriate for implementing the components of the embodiments in a distributed manner including but not limited to TCP/IP sockets, RPC, RMI, HTTP, Web Services (XML-RPC, JAX-RPC, SOAP, and the like). Other variations are possible. Also, other functionality could be provided by each component/module, or existing functionality could be distributed amongst the components/modules in different ways, yet still achieve the functions of the remote 128.

Furthermore, in some embodiments, some or all of the components/portions of the logic 210 may be implemented or provided in other manners, such as at least partially in firmware and/or hardware, including, but not limited to one or more application-specific integrated circuits ("ASICs"), standard integrated circuits, controllers (e.g., by executing appropriate instructions, and including microcontrollers and/or embedded controllers), field-programmable gate arrays ("FPGAs"), complex programmable logic devices ("CPLDs"), and the like. Some or all of the system components and/or data structures may also be stored as contents (e.g., as executable or other machine-readable software instructions or structured data) on a computer-readable medium (e.g., as a hard disk; a memory; a computer network or cellular wireless network; or a portable media article to be read by an appropriate drive or via an appropriate connection, such as a DVD or flash memory device) so as to enable or configure the computer-readable medium and/or one or more associated computing systems or devices to execute or otherwise use or provide the contents to perform at least some of the described techniques. Such computer program products may also take other forms in other embodiments. Accordingly, embodiments of this disclosure may be practiced with other computer system configurations.

Figure 3:
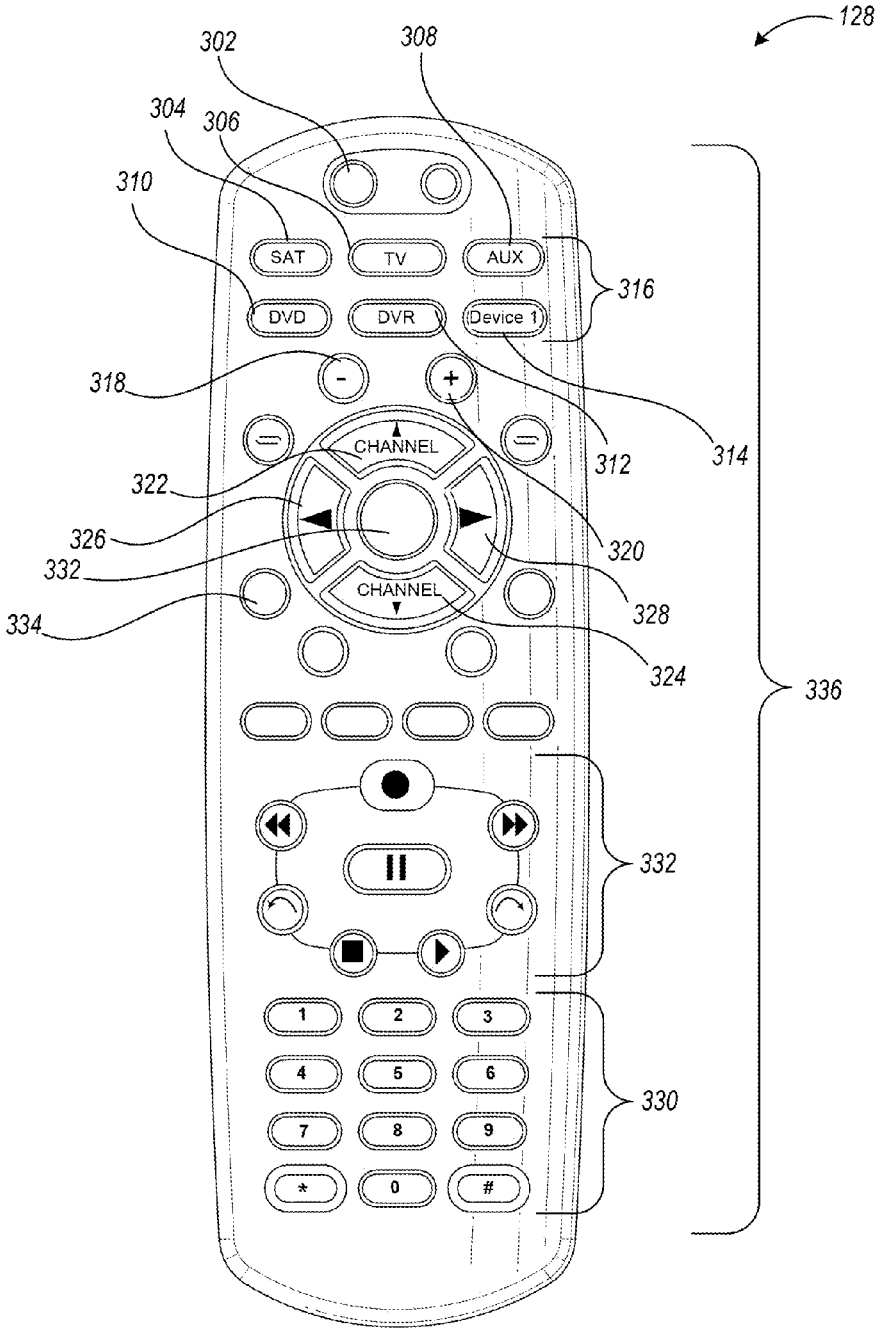
FIG. 3 is a diagram illustrating top plan view of an example embodiment of a remote-control device for limiting remote-control device mode changes.

FIG. 3 is a diagram illustrating top plan view of an example embodiment of a remote 128 for limiting remote-control device mode changes. Shown is the remote 128 according to one example embodiment. However, different buttons, different button configurations and various different types of input controls, including, but not limited to, those described herein with respect to I/O controls 204 with reference to FIG. 2, may be present in various other embodiments.

Included on the example remote 128 shown in FIG. 3 is an example group of controls 336. The group of controls 336 include a power button 302; a plurality of mode buttons 316, including a satellite mode button 304, a TV mode button 306, an auxiliary mode button 308 and a "Device 1" mode button 314; a volume down button 318, a volume up button 320; a channel up button 322 (which also operates as an up directional key); a channel down button 324 (which also operates as a down directional key); a left directional key 326; a right directional key 328; a select button 332; a set of media player control buttons 332, including record, play, pause, fast forward, rewind, skip forward and skip backward buttons; a numeric keypad 330 and a mode limiting command button 334. Additional or different controls may also be present on the back of the remote 128, for example a QWERTY keyboard, which may be active in various different modes.

Additional, fewer, or different buttons or other controls may also be present in the group of controls 336 corresponding to other or different functionality of various devices. For example, some embodiments do not include the mode limiting command button 334. Other buttons or controls may control other media device settings, on-demand services, purchase requests, and general menu and graphical user interface (GUI) navigation. The dimensions and overall shape of the remote 128 may vary depending on the positioning and placement of the group of controls 336, the positioning of the particular internal electronics of the remote 128 components shown in FIG. 2, and any modifications for ease and comfort of use of the remote 128.

Other menus, interfaces and applications may be displayed and controlled using the remote 128 directional keys 322, 324, 326, 328 to control movement of the cursor or other menu navigation and/or using the keypad 330 and/or QWERTY keyboard (not shown) on the back of the remote 128 to enter text or other input into the various menus, interfaces and applications in communication with the presentation device 120, auxiliary device 122 and/or the receiving device 118. Examples of such other menus, interfaces and applications include, but are not limited to, menus, interfaces and applications of: televisions, satellite and cable receivers, DVD players, game consoles, computers, mobile devices, tablets and computer networks. Other such examples include digital video or audio recorders or players, analog video or audio recorders or players, stereo equipment, home appliances, mobile devices, MP3 players, cellular phones, home entertainment systems, home theater systems, smart home systems, home electromechanical systems, such as a lighting system, security system, climate control system, spa/pool, and the like, or other media devices, etc.

The satellite mode button 304, when pressed, causes the remote 128 to enter a "satellite" mode in which the group of controls 336 is configured to control a satellite receiver. The television mode button 306, when pressed, causes the remote 128 to enter a "TV" mode in which the group of controls 336 is configured to control a television. The auxiliary mode button 308, when pressed, causes the remote 128 to enter an "auxiliary" mode in which the group of controls 336 is configured to control an auxiliary device. The DVD mode button 310, when pressed, causes the remote 128 to enter a "DVD" mode in which the group of controls 336 is configured to control a DVD player. The DVR mode button 312, when pressed, causes the remote 128 to enter a "DVR" mode in which the group of controls 336 is configured to control a digital video recorder. The "Device 1" mode button 314, when pressed, causes the remote 128 to enter a "Device 1" mode in which the group of controls 336 is configured to control a device selected by a user.

Additional or different modes and corresponding mode buttons may be included on the remote 128 in various other embodiments. In some embodiments, the remote 128 may also or instead enter into a number of different modes, each mode corresponding to a particular physical orientation, switch position, current menu or interface selected, current device being communicated with, or a combination of the foregoing items. The current menu or device with which the remote 128 is communicating may also affect the particular mode in which the remote 128 is operating. This may be enabled by two-way communication between the remote 128 and the particular device (e.g., presentation device 120, auxiliary device 122 and/or receiving device 118).

In one embodiment, a user may enter a command to limit mode changes and, in response, the remote 128 will prevent mode changes from the current mode to any other mode or to a group of other modes. For example, while the remote is in the "satellite" mode in which the channel up button 322 and channel down button 324 are configured to control channel changes on a satellite television receiver, the user may enter the command to limit mode changes and, in response, the remote 128 will prevent mode changes from the satellite mode to the TV mode and the auxiliary mode, even if the TV mode button 306 or the auxiliary mode button 308 on the remote 128 is pressed. Otherwise, if the TV mode button 306 is pressed, the remote 128 would normally enter into the TV mode in which activation of the channel up button 322 and channel down button 324 would cause the TV to change channels on the TV instead of the satellite receiver changing channels on the satellite receiver. Likewise, if the command to limit mode changes was not entered, when the auxiliary mode button 308 is pressed, the remote 128 would normally enter into auxiliary mode in which activation of the channel up button 322 and channel down button 324 would cause the auxiliary device to change channels on the auxiliary device instead of the satellite receiver changing channels on the satellite receiver. In some embodiments, entering such a command will result in the remote 128 preventing changes from the satellite mode to the DVD mode, from the satellite mode to the DVR mode and from the satellite mode to the "Device 1" mode even if the DVD mode button 310, the DVR mode button 312 or the "Device 1" mode button 314 on the remote 128 is pressed.

The user may input the command to limit mode changes by activating on the remote 128 a particular button, a sequence of buttons or by holding down a button for a specific period of time, or a combination thereof. For example, the user may input the command to limit mode changes by pressing a dedicated mode limiting command button 334 on the remote 128. In other embodiments, the user may input the command to limit mode changes by holding down for a specific period of time the mode button corresponding to the mode from which changes are to be limited. For example, if the user would like to limit mode changes from the satellite mode to the other modes, the user may hold down the satellite mode button for a specific period of time (e.g., five seconds). This will result in the remote 128 preventing changes from the satellite mode to other modes. Accordingly, if the user would like to limit mode changes from the TV mode to the other modes, the user may hold down the TV mode button for a specific period of time (e.g., five seconds). While causing the remote to change to TV mode if not already in TV mode, this will also result in the remote 128 preventing changes from the TV mode to other modes.

The remote 128 may be in this limited mode state in which other modes are "locked out" until such time the user enters a command to allow mode changes again. For example, holding down a mode button for a specific period of time may instead allow mode changes again. In some embodiments, pressing the same particular button, or sequence of buttons, again that the user pressed to cause the remote to prevent mode changes may cause the remote 128 to allow mode changes again. In this manner, the user may use the same input sequence to cause the remote 128 to toggle between preventing and allowing mode changes.

The ability to make the remote 128 prevent or allow mode changes may also be limited to, or otherwise based on, particular users or permissions. For example, a user may be identified by the remote 128, or other system in communication with the remote 128, as an authorized user or as a user otherwise having permission to cause the remote 128 to prevent or allow mode changes. This may be performed by a fingerprint scanner on the remote 128 (not shown), by other biometric identification of the user or by the user otherwise providing credentials for authentication to the remote 128 or a system in communication with the remote 128. For example, the ability to cause the remote to prevent or allow mode changes may be password protected, such that the user must provide a password or other identifier (e.g., a PIN, biometric identifier, etc.) to access this protected feature. As a result of being identified as an authorized user, the remote 128 may accept the command to prevent or allow mode changes. In some embodiments, mode changes may be allowed only by authorized users identified by the remote 128 or a system in communication with the remote 128.

Figure 4:
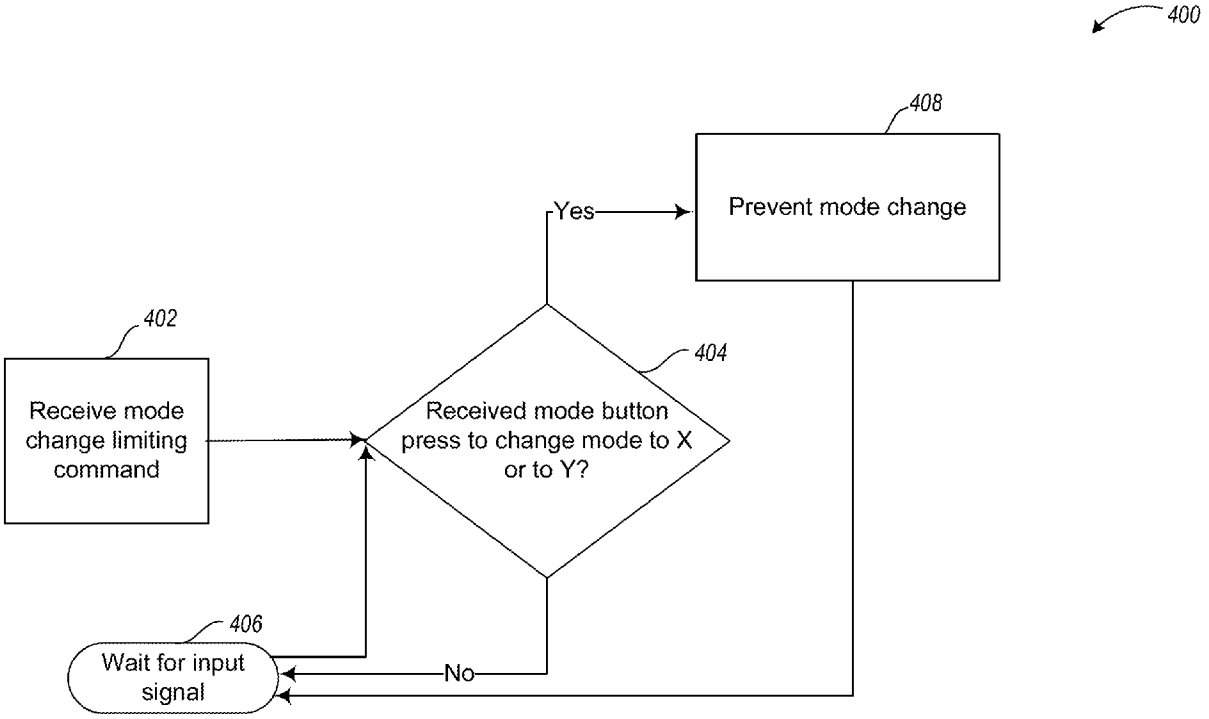
FIG. 4 is a flow diagram of a process for limiting remote-control device mode changes provided by a first example embodiment.

FIG. 4 is a flow diagram of a process 400 for limiting remote-control device mode changes provided by a first example embodiment.

At 402 the remote 128 receives a mode change limiting command.

At 404 the remote 128 makes a determination whether a mode button was pressed to change to mode X and makes a determination whether a mode button was pressed to change to mode Y. If a mode button was pressed to change to either of mode X or mode Y, the process proceeds to 408. If the remote 128 determined a mode button was not pressed to change to either of mode X or mode Y, the remote proceeds to 406.

At 408, the remote 128 prevents the mode to change to mode X and mode Y.

At 406, the process waits for an input signal on the remote 128.

Figure 5:
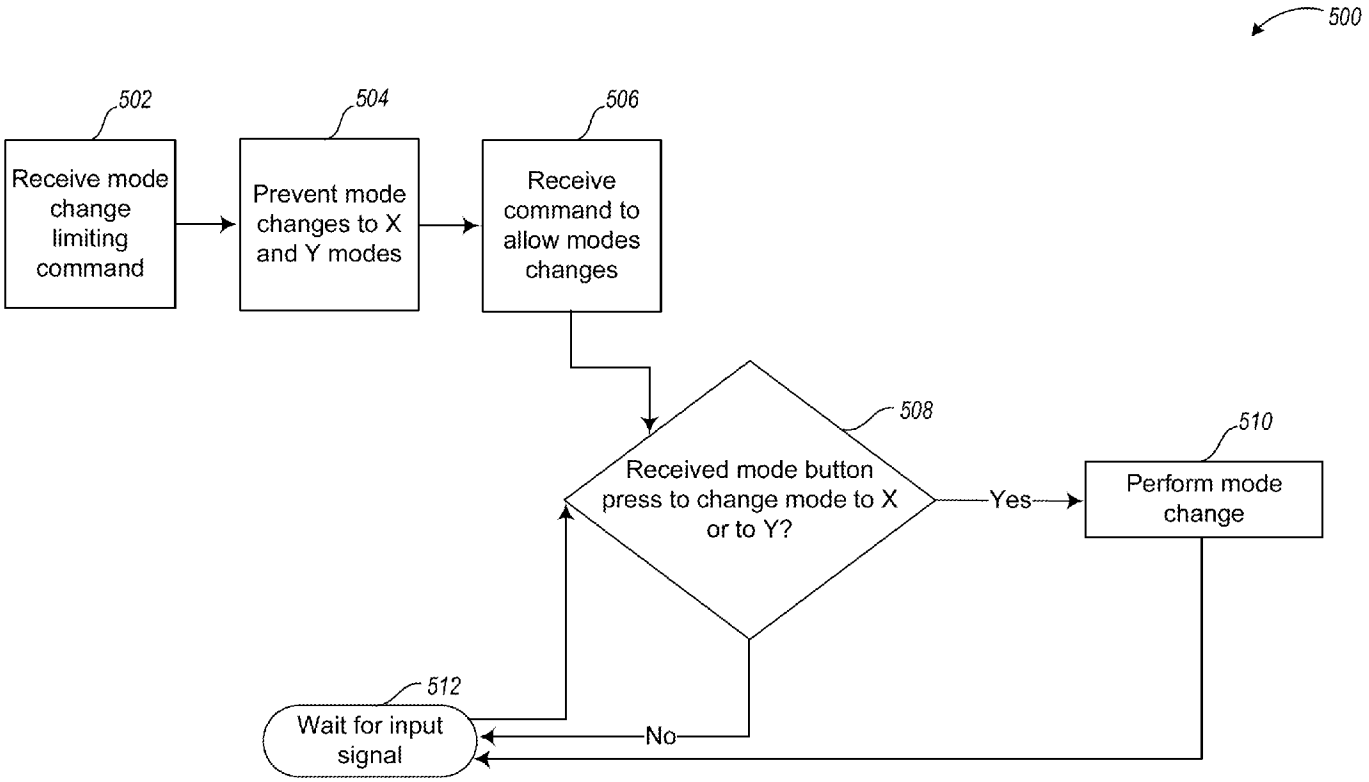
FIG. 5 is a flow diagram of a process for limiting remote-control device mode changes provided by a second example embodiment.

FIG. 5 is a flow diagram of a process 500 for limiting remote-control device mode changes provided by a second example embodiment.

At 502, the remote 128 receives a mode change limiting command.

At 504, the remote 128 prevents mode changes to X and Y modes.

At 506, the remote 128 receives a command to allow mode changes.

At 508 the remote 128 makes a determination whether a mode button was pressed to change to mode X and makes a determination whether a mode button was pressed to change to mode Y. If a mode button was pressed to change to either of mode X or mode Y, the process proceeds to 510. If the remote 128 determined a mode button was not pressed to change to either of mode X or mode Y, the remote proceeds to 512.

At 510, the remote 128 performs the mode change corresponding to the button pressed.

At 512, the process waits for an input signal on the remote 128.

Figure 6:
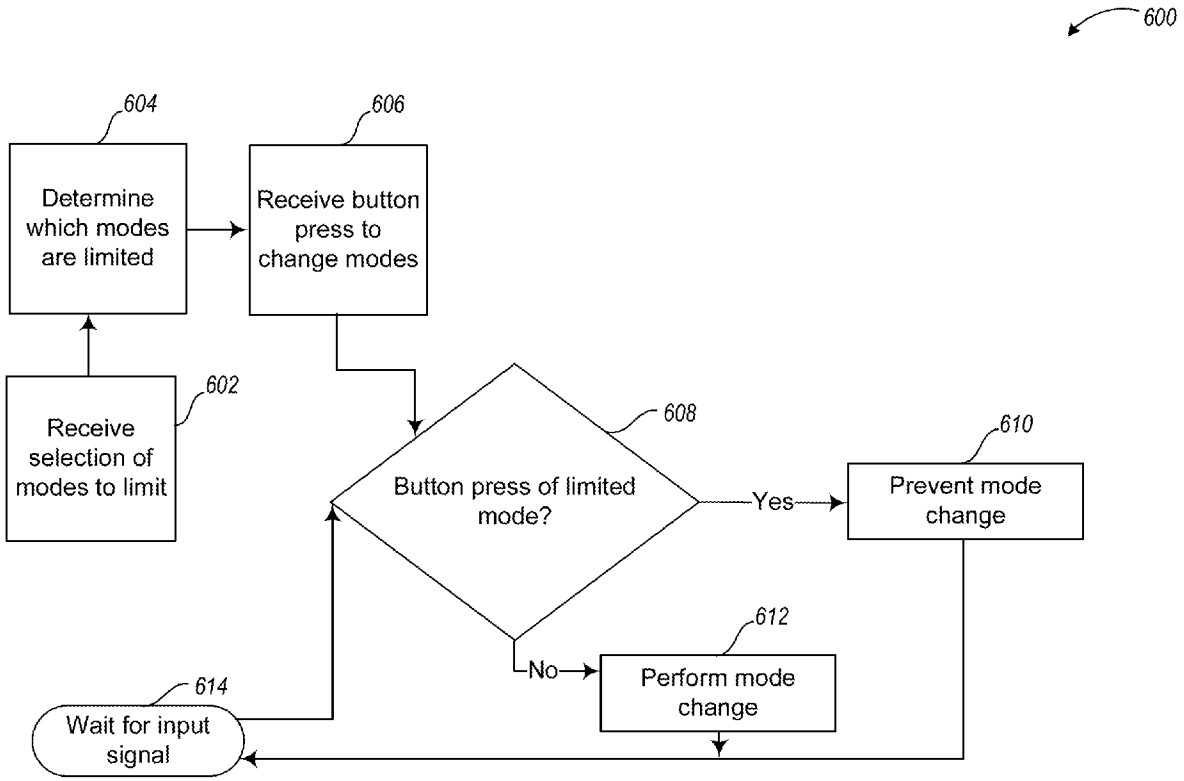
FIG. 6 is a flow diagram of a process for limiting remote-control device mode changes provided by a third example embodiment.

FIG. 6 is a flow diagram of a process 600 for limiting remote-control device mode changes provided by a third example embodiment.

At 602, the remote 128 receives a selection of modes to limit. In particular, the remote will be prevented from entering the modes in the selection of modes to limit. Such a selection may be made by an end user or the manufacturer of the remote.

At 604, the remote 128, determines which modes are limited based on the selection received.

At 606, the remote 128 receives a button press to change modes.

At 608 the remote 128 makes a determination whether the button press to change modes is for a mode that was limited. If the remote 128 determines that the button press to change modes is for a mode that was limited, the remote proceeds to 610. If the remote 128 determines that the button press to change modes is not for a mode that was limited, the remote proceeds to 612.

At 610, the remote 128 prevents the mode change to the mode corresponding to the button pressed.

At 612, the remote 128 performs the mode change corresponding to the button pressed.

At 614, the process waits for an input signal on the remote 128.

Figure 7:
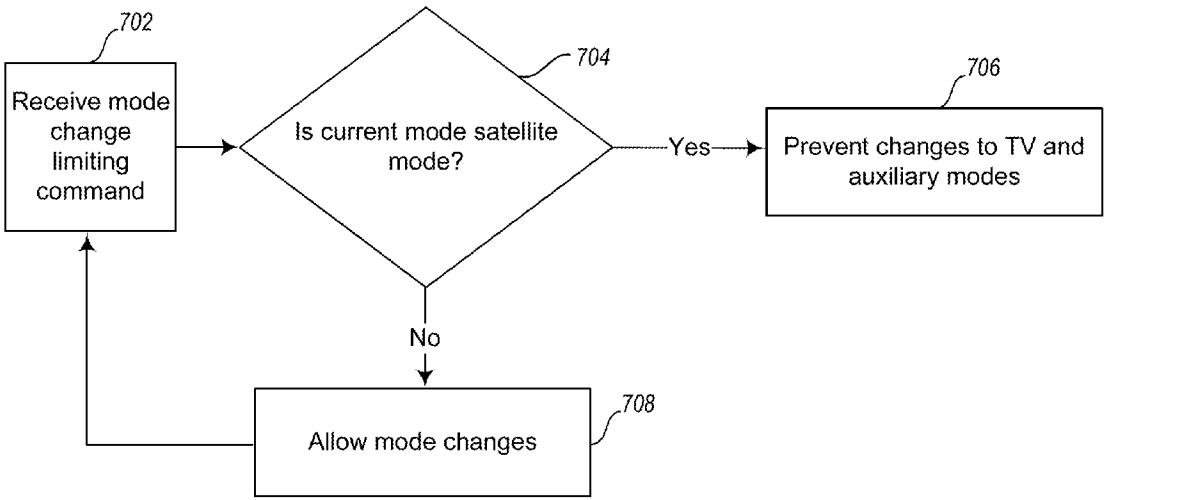
FIG. 7 is a flow diagram of a process for limiting remote-control device mode changes provided by a fourth example embodiment.

FIG. 7 is a flow diagram of a process 700 for limiting remote-control device mode changes provided by a fourth example embodiment.

At 702, the remote 128 receives a mode change limiting command.

At 704, the remote 128 determines whether the current mode is a satellite mode. If the remote 128 determines that the current mode is a satellite mode, the process proceeds to 706. If the remote 128 determines that the current mode is not a satellite mode, the process proceeds to 708.

At 706, the remote 128 prevents changes to television and auxiliary modes from the satellite mode.

At 708, the remote 128 allows mode changes.

From the foregoing it will be appreciated that, although specific embodiments of the invention have been described herein for purposes of illustration, various modifications may be made without deviating from the scope of the invention. Accordingly, the invention is not limited except as by the appended claims.

The invention claimed is:

1. A remote-control device comprising:

a remote-control device housing;

a system control module within the housing;

a set of input controls positioned on the housing communicatively coupled to the system control module; and a plurality of mode controls positioned on the housing communicatively coupled to the system control module, wherein each of the plurality of mode controls is initially configured to, when activated, cause the remote-control device to go into a corresponding one of a plurality of at least three different modes in which the set of input controls is configured to perform different functions depending on a corresponding different mode of the plurality of different modes, and wherein the system control module is configured to:

receive input including a command to limit mode changes; and in response to receiving the input including a command to limit mode changes, prevent the remote-control device from changing from one of the plurality of different modes to at least two other different modes of the plurality of different modes when any of the plurality of mode controls corresponding to the at least two other different modes of the plurality of different modes are activated.

2. The remote-control device of claim 1 wherein the system control module is configured to, in response to receiving the input including a command to limit mode changes, prevent the remote-control device from changing from the one of the plurality of different modes to any of the other different modes when any of the mode controls corresponding to any of the other different modes are activated.

3. The remote-control device of claim 1 wherein the system control module is configured to, in response to receiving the input including a command to limit mode changes, prevent the remote-control device from changing from a current mode of the plurality of different modes to any of the other different modes when any of the mode controls corresponding to any of the other different modes are activated.

4. The remote-control device of claim 1 wherein the one of the plurality of different modes from which the remote-control device is prevented changing is a satellite mode in which the set of input controls is configured to perform functions to control a satellite television receiver and one of the plurality of mode controls corresponds to the satellite mode.

5. The remote-control device of claim 4 wherein the at least two of the other different modes which the remote-control device is prevented from changing to include:

a TV mode in which the set of input controls is configured to perform functions to control a television while in the TV mode, wherein one of the plurality of mode controls corresponds to the TV mode; and an auxiliary mode in which the set of input controls is configured to perform functions to control an auxiliary media device while in the auxiliary mode, wherein one of the plurality of mode controls corresponds to the auxiliary media device.

6. The remote-control device of claim 1 wherein the input including a command to limit mode changes is caused by one or more activations of one or more controls on the remote-control device that are communicatively coupled to the system control module.

7. The remote-control device of claim 1 wherein the set of input controls and the plurality of mode controls are buttons.

8. The remote-control device of claim 1 wherein the system control module is further configured to:

receive input including a command to allow mode changes; and in response to receiving the input including a command to allow mode changes, allow changing between any of the plurality of different modes when any of the mode controls corresponding to different modes are activated.

9. The remote-control device of claim 1 wherein the input including a command to allow mode changes is caused by one or more activations of one or more controls on the remote-control device that are communicatively coupled to the system control module.

10. The remote-control device of claim 1 wherein the system control module is configured to prevent the remote-control device from changing from one of the plurality of different modes to at least two of the other different modes by at least being configured to:

in response to receiving the input including a command to limit mode changes, ignore any activation of the mode controls corresponding to the at least two of the other different modes.

11. The remote-control device of claim 1 wherein the system control module is configured to prevent the remote-control device from changing from one of the plurality of different modes to at least two of the other different modes by at least being configured to:

in response to receiving the input including a command to limit mode changes, disable the mode controls corresponding to the at least two of the other different modes.

12. The remote-control device of claim 1 wherein the system control module is configured to prevent the remote-control device from changing from one of the plurality of different modes to at least two of the other different modes by at least being configured to:

in response to activation of a mode control corresponding to one of the at least two of the other different modes, temporarily go into a corresponding different mode corresponding to the activation of the mode control; and in response to going into the corresponding different mode, immediately change back to the one of the plurality of different modes the remote-control device was in before the change.

13. The remote-control device of claim 1 wherein the set of input controls includes a volume control and the different functions include volume control of different devices.

14. The remote-control device of claim 1 wherein the set of input controls includes a channel change control and the different functions include channel change control of different devices.

15. The remote-control device of claim 1 wherein the set of input controls includes a power on/off control and the different functions include power on/off control of different devices.

16. The remote-control device of claim 1 wherein the set of input controls includes directional and menu selection controls and the different functions include directional and menu selection controls for different devices.

17. The remote-control device of claim 1 further comprising an indicator configured to indicate whether the remote-control device is currently is a state to prevent mode changes.

18. The remote-control device of claim 1 wherein the system control module is further configured to:

receive input indicating a selection of multiple of the plurality of different modes to prevent the remote-control device from changing to; and in response to receiving the input indicating the selection of multiple of the plurality of different modes, prevent the remote-control device from changing to the selected multiple of the plurality of different modes.

19. The remote-control device of claim 1 wherein the system control module is further configured to:

receive input indicating a selection of multiple of the plurality of different modes to allow the remote-control device to change between; and in response to receiving the input indicating the selection of multiple of the plurality of different modes, allow the remote-control device to change between the selected multiple of the plurality of different modes.

20. A method for controlling operation of a remote-control device comprising:

receiving input including a command to limit mode changes between a plurality of different modes including at least three different modes of the remote-control device; and in response to receiving the input including a command to limit mode changes between a plurality of different modes including at least three different modes of the remote-control device, preventing the remote-control device from changing from one of the plurality of different modes to at least two other different modes of the plurality of different modes when any mode controls on the remote-control device corresponding to the at least two other different modes are activated;

receiving input including a command to allow mode changes of the remote-control device; and in response to receiving the input including a command to allow mode changes of the remote-control device, allowing changing between any of the plurality of different modes when any corresponding mode control on the remote-control device corresponding to one of the plurality different modes is activated.

21. The method of claim 20 wherein the one of the plurality of different modes from which the remote-control device is prevented changing is a satellite mode in which a set of input controls on the remote-control device is configured to perform functions to control a satellite television receiver as a result of one of the mode controls corresponding to the satellite mode being activated.

22. The method of claim 21 wherein the at least two other different modes which the remote-control device is prevented from changing to include:

a TV mode in which the set of input controls on the remote-control device is configured to perform functions to control a television, wherein one of the mode controls on the remote-control device corresponds to the TV mode; and an auxiliary mode in which the set of input controls is configured to perform functions to control an auxiliary media device, wherein one of the mode controls on the remote-control device corresponds to the auxiliary media device.

23. A non-transitory computer readable storage medium having computer executable instructions thereon, that when executed by a computer processor cause the following method for controlling operation of a remote-control device to be performed:

receiving input including a command to put a remote-control device into a satellite mode in which a set of input controls on the remote-control device is configured to perform functions to control a satellite television receiver while in the satellite mode;

receiving input including a command which limits mode changes of the remote-control device; and in response to receiving the input including the command which limits mode changes of the remote-control device:

limiting mode changes of the remote-control device from the satellite mode to a TV mode, the TV mode being a mode in which functions of the set of input controls on the remote-control device is changed to perform functions to control a television while the remote-control device is in the TV mode; and limiting mode changes of the remote-control device from the satellite mode to an auxiliary mode, the auxiliary mode being a mode in which the set of input controls is changed to perform functions to control an auxiliary media device while the remote-control device is in the auxiliary mode.

24. The non-transitory computer readable storage medium of claim 23 wherein a satellite mode control button on the remote-control device corresponds to the satellite mode, an auxiliary mode control button on the remote-control device corresponds to the auxiliary mode and TV mode control button on the remote-control device corresponds to the TV mode.

25. The non-transitory computer readable storage medium of claim 24 wherein the computer executable instructions, when executed by a computer processor, further cause the following to be performed:

receiving input including a command to allow mode changes; and in response to receiving the input including a command to allow mode changes, switching from limiting mode changes from the satellite mode to the TV mode and the auxiliary mode to allowing changing between the satellite mode, the TV mode and the auxiliary mode.

* * * * *